US011905783B2

(12) United States Patent
Randle

(10) Patent No.: US 11,905,783 B2
(45) Date of Patent: Feb. 20, 2024

(54) RISER SYSTEM

(71) Applicant: Spoked Solutions LLC, Houma, LA (US)

(72) Inventor: Bryce Elliott Randle, Highlands Ranch, CO (US)

(73) Assignee: Spoked Solutions LLC, Houma, LA (US)

( * ) Notice: Subject to any disclaimer, the term of this patent is extended or adjusted under 35 U.S.C. 154(b) by 0 days.

(21) Appl. No.: 17/157,613

(22) Filed: Jan. 25, 2021

(65) Prior Publication Data

US 2021/0215012 A1 Jul. 15, 2021

Related U.S. Application Data

(63) Continuation of application No. 16/230,456, filed on Dec. 21, 2018, now Pat. No. 10,900,314.

(60) Provisional application No. 62/608,700, filed on Dec. 21, 2017.

(51) Int. Cl.
*E21B 33/038* (2006.01)
*E21B 33/06* (2006.01)
*E21B 17/05* (2006.01)

(52) U.S. Cl.
CPC ..... *E21B 33/038* (2013.01); *E21B 17/05* (2013.01); *E21B 33/062* (2013.01)

(58) Field of Classification Search
CPC .... E21B 33/035; E21B 33/038; E21B 33/062; E21B 17/05
See application file for complete search history.

(56) References Cited

U.S. PATENT DOCUMENTS

| | | | | |
|---|---|---|---|---|
| 3,602,303 | A * | 8/1971 | Blenkarn | E21B 33/076 166/360 |
| 4,234,043 | A * | 11/1980 | Roberts | E21B 33/0355 166/336 |
| 5,860,478 | A * | 1/1999 | Coutts | E21B 34/045 166/356 |
| 6,253,854 | B1 * | 7/2001 | Fenton | E21B 33/043 166/363 |
| 7,419,001 | B2 * | 9/2008 | Broussard | E21B 33/0422 166/77.51 |
| 9,033,052 | B2 * | 5/2015 | Robichaux | E21B 33/085 166/358 |
| 9,470,045 | B2 * | 10/2016 | Robichaux | E21B 33/064 |
| 10,100,615 | B2 * | 10/2018 | Randle | E21B 21/01 |
| 2008/0110633 | A1 * | 5/2008 | Trewhella | E21B 33/04 166/336 |
| 2016/0123116 | A1 * | 5/2016 | Randle | E21B 43/08 166/205 |

* cited by examiner

*Primary Examiner* — Aaron L Lembo
(74) *Attorney, Agent, or Firm* — Heuton IP Law, LLC

(57) ABSTRACT

A riser system is provided to eliminate the consequences associated with damage to the annular system while also maintaining the availability of critical safety systems. The riser system may comprise a customizable control housing and external seal control subs that facilitate reciprocation and rotation of a drillpipe or workstring while eliminating damage to the upper annular blow out preventer and allowing the upper annular blow out preventer to function as intended.

12 Claims, 4 Drawing Sheets

RISER SYSTEM

CROSS REFERENCE TO RELATED APPLICATION

This application is a continuation of U.S. patent application Ser. No. 16/230,456, filed on Dec. 21, 2018, now U.S. Pat. No. 10,900,314, which claims the benefit of U.S. Provisional Application No. 62/608,700, filed on Dec. 21, 2017, both of which are incorporated by reference in their entirety.

FIELD OF THE INVENTION

The present invention relates to a system that integrates into oilfield riser and Blow Out Preventer (BOP) systems to increase functionality of existing technology and infrastructure during various oilfield operations. In particular, but not exclusively, the invention relates to a tool for, and a method of, isolating portions of a riser system to increase reciprocating, rotational, and pressure ratings of riser pipes used during drilling, interventions, and completion/workovers of offshore wells.

BACKGROUND OF THE INVENTION

Riser pipes are used to connect a BOP system or well at the seabed and a rig. In some cases such as with a compliant towers, the riser is utilized to connect the subsea wellhead or subsea tree to a platform. The larger internal diameter of riser in relation to its pressure ratings relative to the ratings of a BOP system below and the rig system above is typically lower and contains operating limitations. In addition, in many operations it is desired to isolate the annulus above the BOP annular system, e.g. Hydril, but permit drillpipe to rotate and reciprocate, however, damage to the annular system is often a consequence and thus decreasing the capabilities of safety systems. One prior art system, disclosed in U.S. Pat. Nos. 8,567,507; 9,033,052; and 9,470,045, which are incorporated by reference in their entireties, has attempted to prevent damage to the annular system while isolating the annulus above the annular BOP system while permitting drillpipe to rotate and reciprocate. Such system presents significant disadvantages however, as it is reliant upon substantially jeopardizing safety measures because it operates by closing one of two annular BOPs, eliminating the backup annular while the system is in use. Therefore, there is a need for a solution that allows an operator to isolate the annulus above the annular BOP system while permitting drillpipe to rotate and reciprocate, but without eliminating the redundancy of a backup annular BOP and significantly jeopardizing the safety of personnel and equipment.

SUMMARY OF THE INVENTION

It is the intent of the Do More Riser System (DMRS) to increase the functionality of all systems combined by minimizing the limiting characteristics of the riser components. Additionally, the DMRS eliminates the consequences associated with damage to the annular system while also maintain the availability of critical safety systems. The DMRS integrates into and is configurable for both new and existing riser and BOP systems. It is customizable and has the ability to be redressed offshore for multiple installation/removals and is designed to fit into various internal diameter systems. The uniqueness of the DMRS permits it to interact with existing BOP systems or to perform solo and thus reduce the potential for BOP functionality flaws or limitation.

It is an aspect of embodiments of the present invention to integrate into new or existing riser systems seamlessly by insertion of a 'riser adapter' that makes up to riser above and flex joint below.

It is another aspect of embodiments of the present invention to be capable of withstanding pressures and forces typically and not typically experienced by riser and BOP systems.

It is a further aspect of embodiments of the present invention to have a 'riser adapter' that contains a profile to accept a control housing.

It is yet another aspect of embodiments of the present invention for the control housing to be installable and removable using a running tool.

It is an aspect of embodiments of the present invention for the control housing to be lockable and unlockable.

It is a further aspect of embodiments of the present invention to allow reciprocation and rotation of drillpipe without eliminating the redundancy of the annular BOPs by taking one of the annular BOPS offline.

It is another aspect of embodiments of the present invention for the control housing to remain stationary during reciprocating, rotating, pumping, and a host of other operations typically executed.

It is yet another aspect of embodiments of the present invention for the control housing to not affect the operation of shear or blind rams below the annular BOP system in the BOP system stack.

It is an aspect of embodiments of the present invention for the control housing diameters and length to be customizable as required to allow (1) an annular BOP to close on the outside diameter of the control housing for stabilization and pressure separation or (2) for the annular BOP to be allowed to function and operate as intended with no obstruction from the DMRS thus providing a backup to the DMRS sealing capability.

It is another aspect of embodiments of the present invention for the control housing to incorporate (or improve upon) the sealing technology from Spoked Solutions' Marine Riser Reversing Tool (MRRT), disclosed in U.S. patent application Ser. No. 14/926,326, which is incorporated by reference in its entirety, to provide annular pressure isolation to eliminate modification to flex joint.

It is a further aspect of embodiments of the present invention for the DMRS' seal system to integrate into existing drillpipe strings.

It is yet another aspect of embodiments of the present invention for the DMRS' seal system to consist of subs containing customizable threads to make up to various drillpipe and workstrings.

It is yet another aspect of embodiments of the present invention for the DMRS' seal system to incorporate bonded seal technology with a thrust bearing design.

It is an aspect of embodiments of the present invention for the DMRS' seal system to permit smooth reciprocation (or minimum friction) within the control housing.

It is another aspect of embodiments of the present invention for the DMRS' seal system to permit rotation of the drillpipe or workstring with little to no rotation of the seal system sealing elements.

It is yet another aspect of embodiments of the present invention to allow use of the choke, kill and boost lines while the control housing is installed.

System meets or exceeds existing BOP pressure ratings.

These and other advantages will be apparent from the disclosure of the invention(s) contained herein. The above-described embodiments, objectives, and configurations are neither complete nor exhaustive. The Summary of the Invention is neither intended nor should it be construed as being representative of the full extent and scope of the invention. Moreover, references made herein to "the invention" or aspects thereof should be understood to mean certain embodiments of the invention and should not necessarily be construed as limiting all embodiments to a particular description. The invention is set forth in various levels of detail in the Summary of the Invention as well as in the attached drawings and Detailed Description and no limitation as to the scope of the invention is intended by either the inclusion or non-inclusion of elements, components, etc. in this Summary of the Invention. Additional aspects of the invention will become more readily apparent from the Detailed Description particularly when taken together with the drawings.

BRIEF DESCRIPTION OF THE DRAWINGS

The accompanying drawings, which are incorporated in and constitute a part of the specification, illustrate embodiments of the disclosure and together with the general description of the disclosure given above and the detailed description of the drawings given below, serve to explain the principles of the disclosures.

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

The invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, and may be modified in numerous ways within the scope and spirit of the invention.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

Figure 1:
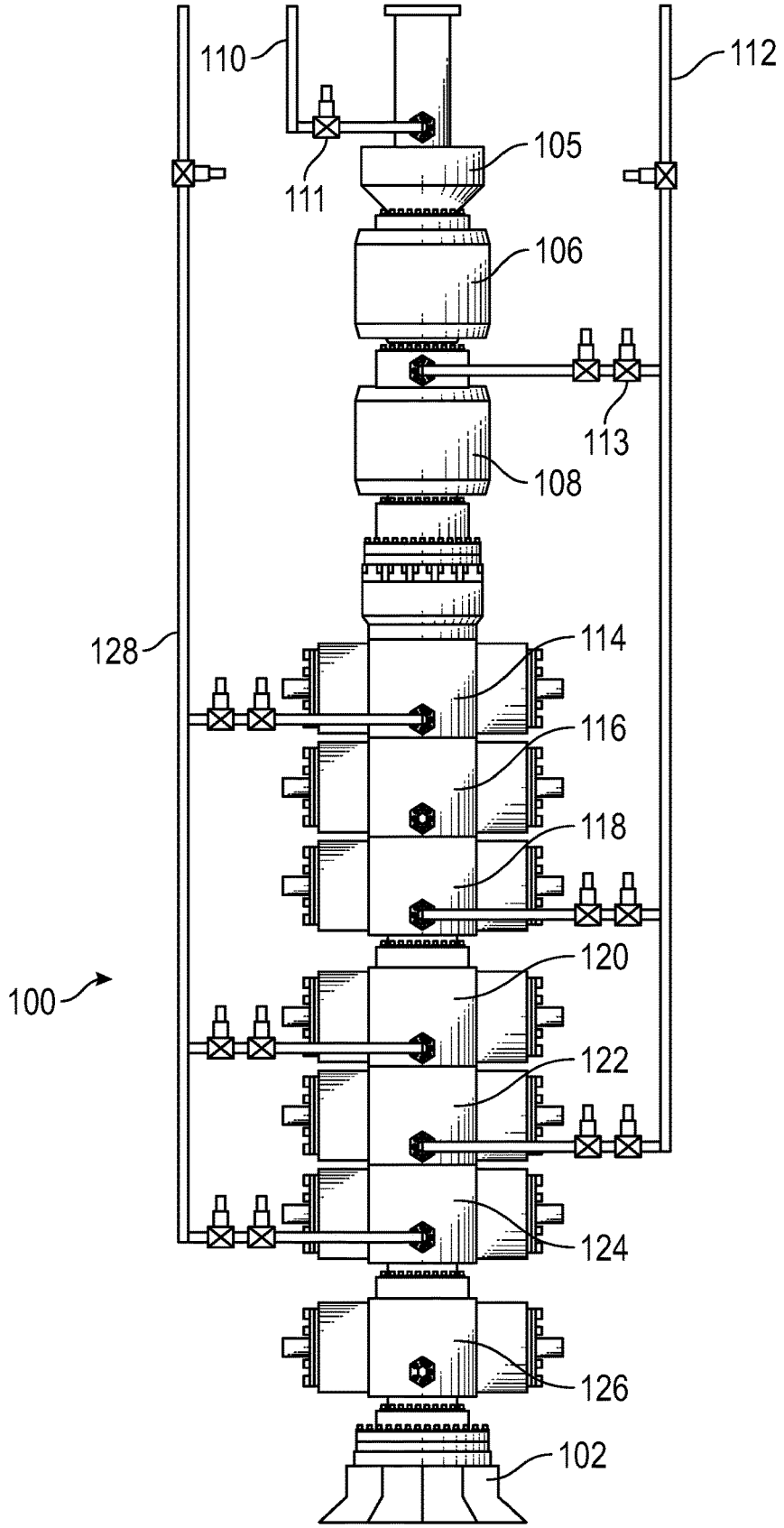
FIG. 1 is a side view of a BOP stack in a preferred embodiment of the present invention.

Now referring to FIG. 1, a side view of a BOP stack in a preferred embodiment of the present invention is provided. In a preferred embodiment, BOP Stack 100 is installed below the last joint of riser 104 and above wellhead connection 102. At the top of BOP Stack 100 is flex joint 105. Boost line 110 enters BOP Stack 100 just above flex joint 105, and is further comprised of one or more boost line valves 111. An upper annular BOP 106 is coupled to flex joint 105 and sits below flex joint 105 in BOP Stack 100. A lower annular BOP 108 sits below and is coupled to upper annular BOP 106. Choke line 112 enters BOP Stack 100 between upper annular BOP 106 and lower annular BOP 108, and is further comprised of one or more choke line valves 113. BOP Stack 100 may be further comprised of upper blind shear ram 114, casing shear ram 116, lower blind shear ram 118, upper variable blind ram 120, middle variable blind ram 122, lower variable blind ram 124, and test ram 126, with kill line 128 entering BOP Stack 100 at various positions between these components. It will be appreciated that not all components of BOP Stack 100 shown in FIG. 1 will be present in all embodiments, or that additional or duplicate components beyond those shown may be present.

Figure 2:
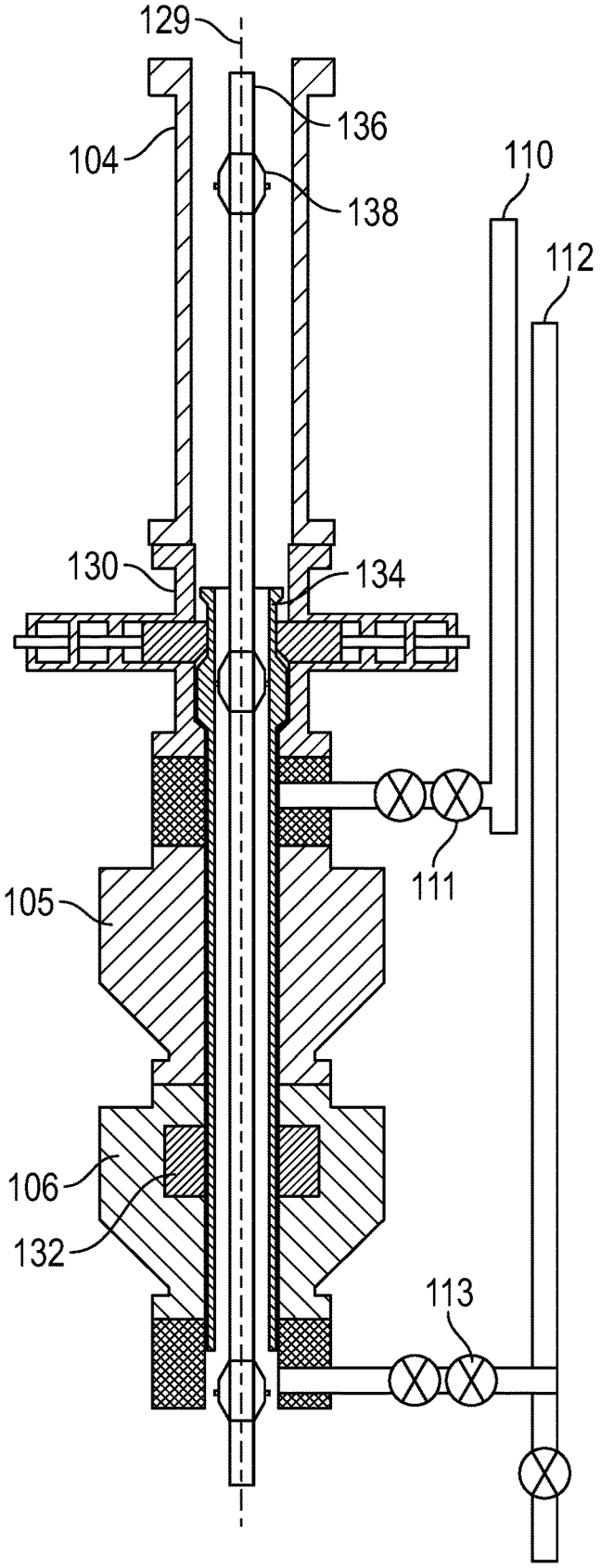
FIG. 2 is a cross-sectional view of a preferred embodiment of the present invention disposed in a portion of a BOP stack.

Now referring to FIG. 2, a cross-sectional view of a preferred embodiment of the present invention disposed in a portion of a BOP stack is provided. As shown in FIG. 1, flex joint 105 sits above upper annular BOP 106, boost line 110 enters BOP Stack 100 just above flex joint 105 and is further comprised of one or more boost line valves 111, and choke line 112 enters BOP Stack 100 below upper annular BOP 106 and is further comprised of one or more choke line valves 113. Upper annular BOP 106 is further comprised of annular seal 132. In a preferred embodiment of the present invention, the lower end of hold down ram assembly 130 is coupled to BOP Stack 100 above flex joint 105 and where boost line 110 enters BOP Stack 100. The last joint of riser 104 is coupled to the upper end of hold down ram assembly 130. In another embodiment of the present invention, hold down ram assembly 130 may be placed below flex joint 105 and above upper annular BOP 106. In other embodiments, hold down ram assembly 130 may be located at any number of places between the rig and the subsea tree. In a preferred embodiment of the present invention, hold down ram assembly 130 integrates seamlessly into the BOP Stack 100 design and is as easily installable and removable as is the make-up or break-out of adjacent BOP Stack 100 components.

When the riser system in accordance with a preferred embodiment of the present invention is in operation, control housing 134 is disposed within the channel of BOP Stack 100, extending from hold down ram assembly 130 through flex joint 105 to below the annular seal 132 of upper annular BOP 106. Control housing 134 is held downhole by hold down ram assembly 130 when hold down ram assembly 130 is in the closed position, as will be further described below. Workstring 136 consists of joints of tubulars with one or more external seal control subs 138 integrated into the string of tubulars. It will be appreciated that workstring 136 can be comprised of drillpipe, a workstring, or other tubulars. When external seal control sub 138 is disposed within control housing 134, a seal is formed between the outer diameter of seal 166 of external seal control sub 138 and the inner diameter of control housing 134.

Figure 3:
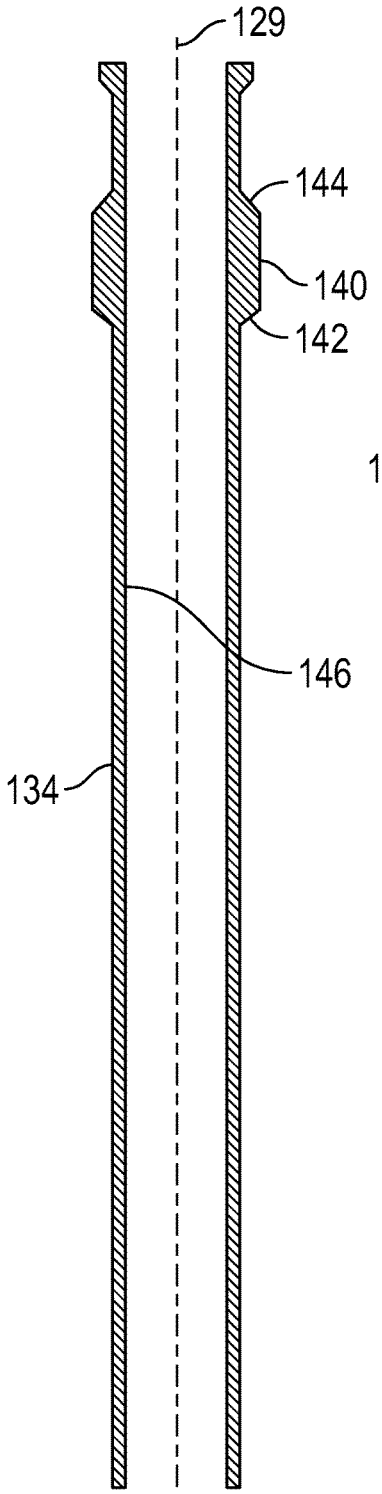
FIG. 3 is a cross-sectional view of a control housing of a preferred embodiment of the present invention.

Now referring to FIG. 3, a cross-sectional view of a control housing of a preferred embodiment of the present invention is provided. Control housing 134 has a cylindrical body that is disposed about central axis 129 and has a uniform inner diameter. The upper end of control housing is further comprised of a raised ridge 140, which is further comprised of a lower shoulder 142 and an upper shoulder 144. In a preferred embodiment of the present invention, raised ridge 140 is fluted to allow for the performance of operations depending upon boost line 110 and/or choke line 112 even when control housing 134 is disposed in the hold down ram assembly 130 because it permits flow bypass from boost line 110 and/or choke line 112. For example, underbalanced drilling can still occur despite control housing 134 being disposed within BOP Stack 100. In a preferred embodiment of the present invention, the interior surface of control housing 134 is polished to reduce friction. In some embodiments of the present invention, control housing 134 is a polished bore receptacle (PBR). It will be appreciated the outer of diameter, length, and inner diameter of control housing 134 can adapted as desired to function with various sizes of BOP Stacks 100 and workstrings 136 as required by the needs of a particular well application. The outer and inner diameter of control housing 134 may also be optimized to minimize forces and increase or control annuli cross sectional areas for boosting or fluid bypass. In some embodiments of the present invention, control housing 134 may be tapered to ease re-entry.

Figure 4A:
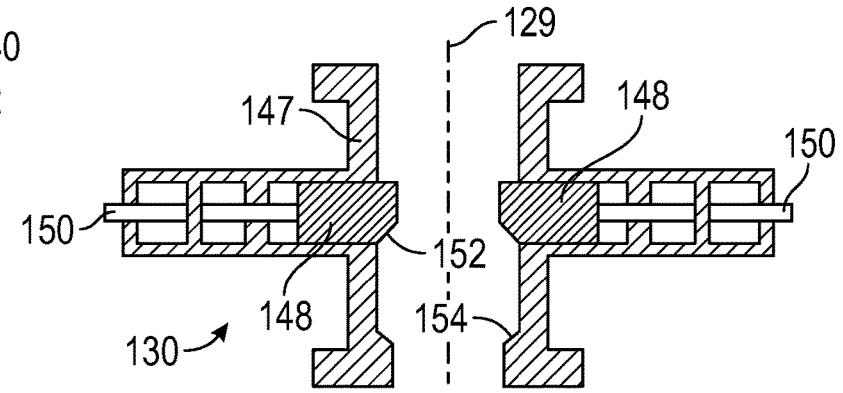
FIGS. 4*a* and 4*b* are cross-sectional views of a hold down ram assembly of a preferred embodiment of the present invention in an open (FIG. 4*a*) and closed (FIG. 4*b*) position.
Figure 4B:
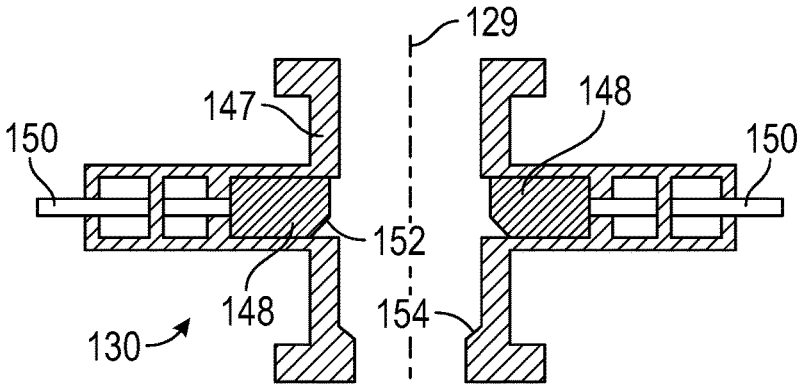

Now referring to FIGS. 4*a* and 4*b*, cross-sectional views of hold down ram assembly 130 of a preferred embodiment of the present invention in an open (FIG. 4*a*) and closed (FIG. 4*b*) position are provided. Hold down ram assembly 130 is comprised of a cylindrical body 147 that is disposed about central axis 129. Body 147 is further comprised of rams 148 that are coupled to pistons 150. Body 147 is further comprised of stop shoulder 154. Rams 148 are further comprised of hold down shoulder 152. Pistons 150 drive rams 148 into an open or closed position. It will be appreciated that pistons 150 can be actuated through various means well known in the art, such as by ROV or hot stabs. In some embodiments of the present invention, hold down ram assembly 130 may be customized to include additional plumbing for hydraulics.

Figure 5:
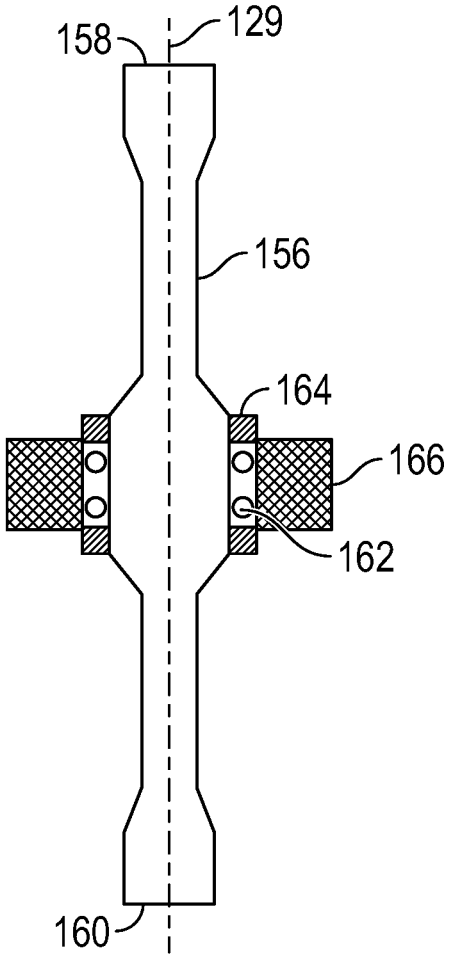
FIG. 5 is a cross-sectional view of an external seal control sub of a preferred embodiment of the present invention.

Now referring to FIG. 5, a cross-sectional view of an external seal control sub of a preferred embodiment of the present invention is provided. External seal control sub 138 is comprised of sub body 156, which is further comprised of upper end 158 and lower end 160. Sub body 156 has a cylindrical body that is disposed about central axis 129. Seal upset area 164 may be comprised of a collar disposed about sub body 156. The outer surface and inner surface of seal upset area 164 may be further comprised of grooves. Seal 166 may be disposed in the groove of the inner surface of seal upset area 164. The outer diameter of bearing 162 may be disposed in the groove of the outer surface of seal upset area 164, while the inner diameter of bearing 162 may be disposed about and coupled to the outer diameter of sub body 156. Bearing 162 can be of any size or type suitable for use in the desired well application, and in one preferred embodiment of the present invention, bearing 162 may be a thrust bearing. Seal 166 can be of any size or type suitable for use in the desired well application. In one embodiment of the present invention, seal 166 may be a molded rubber packer. In another embodiment of the present invention, seal 166 may be a bonded seal. It will be appreciated that when seal 166 forms a seal by contacting the interior surface 146 of control housing 134, the polished interior surface 146 will allow seal 166 to drag along the polished interior surface 146 during reciprocation of workstring 136 with reduced friction and minimal damage to seal 166. It will also be appreciated that when seal 166 forms a seal by contacting the interior surface 146 of control housing 134, bearing 162 allows for the rotation of sub body 156. Thus, seal 166 and bearing 162 of external seal control sub 138 enable the rotation and reciprocation of workstring 136 while a seal of the well above and below the upper annular BOP 106 is maintained without exposing the annular seal 132 to damage through friction caused by such reciprocation and rotation of workstring 136.

In some embodiments, each external seal control sub 138 is a fraction of the length of each tubular joint of workstring 136. Two or more external seal control subs 138 may be run in series as desired. Alternatively, each external seal control sub 138 may be placed between a predetermined number of tubular joints of workstring 136, providing a custom length that workstring 136 may be reciprocated while maintaining contact between seal 166 and the interior surface 146 of control housing 134. In a preferred embodiment, external seal control sub 138 is easily installable at surface when running tubular joints.

In a preferred embodiment of the present invention, the DMRS is installed using the following method. Hold down ram assembly 130 is preferably installed in BOP Stack 100 at the surface before BOP Stack 100 is deployed. Rams 148 of hold down ram assembly 130 will preferably be placed in the open configuration to prevent having to later open the rams before running control housing 134. During the running of riser joints, the last joint of riser 104 is then made up to the upper end of hold down ram assembly 130.

Figure 6:
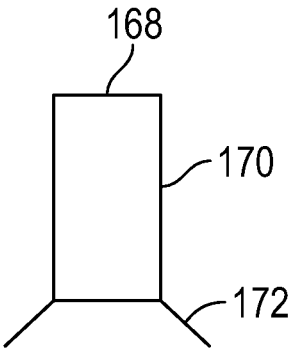
FIG. 6 is a view of a control housing running tool of a preferred embodiment of the present invention.

As shown in FIG. 6, once placement of control housing 134 is desired, control housing running tool 168 can be made up to workstring 136. In some embodiments of the present invention, control housing running tool 168 may be comprised of a sub 170 with butterflied shear pins 172 that freely compress when pins 172 are forced upward, but that hold a predetermined amount of weight when pins 172 are forced downward. Such pins 172 hold the predetermined amount of weight, but shear and freely compress downward once additional weight is applied. Control housing 134 can then be deployed on control housing running tool 168 via workstring 136 by running control housing running tool 168 through the inner channel of control housing 134 from the upper opening of control housing 134 through the lower opening. It will be appreciated that pins 172 will compress upward while control housing running tool 168 is run through control housing 134 and then resume their original position once control housing running tool 168 exits the bottom opening of control housing 134. Control housing 134 will then be supported by butterflied shear pins 172 of control housing running tool 168.

Control housing 134 may then be run downhole. Indication that control housing 134 has reached the desired depth due to the contact of lower shoulder 142 with stop shoulder 154 will occur when weight readings for workstring 136 begin to reduce. Once desired depth is reached, pistons 150 can be actuated by ROV or other means to place rams 148 in the closed position. Control housing running tool 168 can then be released from control housing 134 by pulling the workstring 136 to shear butterflied shear pins 172, thereby allowing butterflied shear pins 172 to compress downward, and retrieved from the well. It will be appreciated that such release may be aided by the contact of upper shoulder 144 with hold down shoulder 152. Control housing 134 will now be deployed in BOP Stack 100 and available for use.

Once control housing 134 is deployed in BOP Stack 100, the desired bottom hole assemblies can be run downhole into the well. As described above, external seal control subs 138 are made up between joints of tubulars in workstring 136 as desired for the specific application, including but not limited to, as needed to customize reciprocation length. Once one or more external seal control subs 138 have been run downhole as needed to place seal 166 of one or more external seal control subs 138 contact with interior surface 146 of control housing 134, bottom hole work may be performed as desired with pressure isolation as needed and all systems of BOP Stack, including boost and choke systems, in place to perform as intended.

After the desired bottom hole work has been completed, workstring 136, including the one or more external seal control subs 138 made up therein, along with the bottom hole assemblies, can be pulled from the well. Control housing running tool 168, with new butterflied shear pins 172, can then be run downhole to pull control housing 134 from the well. Before pulling control housing 134 with control housing running tool 168, rams 148 must be placed into the open position by actuating pistons 150 using an ROV, hot stabs, or other well-known methods, in order to release control housing 134 from hold down ram assembly 130.

Annular seal 132 is not required to be closed for the DMRS to operate. Rather, upper annular BOP 106 is still able to function as designed. In the open position, fluid may be circulated to surface, while in the closed position, the riser is isolated from pressure below. Further, upward forces on the DMRS are not transferred to upper annular BOP 106 when annular seal 132 is in the closed position.

The DMRS is relatively frictionless during reciprocation, thus providing an increased understanding of downhole environment during downhole sleeve manipulation during fracs and interventions. Further, the DMRS simplifies and makes safer rotating and reciprocating during pressure managed cementing and drilling, as well as salt exits and drilling into regressions. The DMRS can also perform solo by having the ability to act as a BOP system when multiple hold down ram assemblies are installed. For example, the rams of the hold down assemblies can close on other objects in the well in addition to the control housing.

The invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed.

The phrases "at least one", "one or more", and "and/or", as used herein, are open-ended expressions that are both conjunctive and disjunctive in operation. For example, each of the expressions "at least one of A, B, and C", "at least one of A, B, or C", "one or more of A, B, and C", "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification, drawings, and claims are to be understood as being modified in all instances by the term "about."

The term "a" or "an" entity, as used herein, refers to one or more of that entity. As such, the terms "a" (or "an"), "one or more" and "at least one" can be used interchangeably herein.

The use of "including," "comprising," or "having," and variations thereof, is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts, and the equivalents thereof, shall include all those described in the summary of the invention, brief description of the drawings, detailed description, abstract, and claims themselves.

The foregoing description of the invention has been presented for illustration and description purposes. However, the description is not intended to limit the invention to only the forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Consequently, variations and modifications commensurate with the above teachings and skill and knowledge of the relevant art are within the scope of the invention. The embodiments described herein above are further intended to explain best modes of practicing the invention and to enable others skilled in the art to utilize the invention in such a manner, or include other embodiments with various modifications as required by the particular application(s) or use(s) of the invention. Thus, it is intended that the claims be construed to include alternative embodiments to the extent permitted by the prior art.

What is claimed is:

1. A method for installing a riser system, comprising:

installing a riser adapter above an annular blow out preventer in a wellbore operation, the riser adapter having an inner surface that defines an interior space and a stop shoulder, the riser adapter further having a ram that moves between a retracted position and an extended position where the ram is at least partially located in the interior space, wherein the ram defines a hold shoulder;

deploying a polished bore receptacle into the riser adapter, wherein a ridge extends from an outer surface of the polished bore receptacle to define a lower shoulder and an upper shoulder, wherein the upper shoulder and the lower shoulder are offset by a predetermined distance;

contacting the lower shoulder of the polished bore receptacle against the stop shoulder of the riser adapter, and extending the ram from the retracted position to the extended position such that the hold shoulder is positioned proximate to the upper shoulder to secure the polished bore receptacle to the riser adapter;

installing a plurality of seal system subs on a string, wherein a distance between two subs of the plurality of seal system subs is less than a distance between an upper end and a lower end of the polished bore receptacle; and lowering the string through the polished bore receptacle to isolate an annular space in the wellbore operation.

2. The method of claim 1, wherein the ram is a first ram, and the riser adapter further comprises a second ram that moves between a retracted position and an extended position and is arranged in an opposing relationship with the first ram.

3. The method of claim 1, wherein the hold shoulder of the ram is a chamfer between a lower surface and a distal surface of the ram.

4. The method of claim 1, wherein the riser adapter is connected to a flex joint of the blow out preventer.

5. The method of claim 1, wherein a riser pipe is connected to the riser adapter.

6. The method of claim 1, wherein a boost line is positioned in the wellbore operation between the ram of the riser adapter and a seal of the blow out preventer, wherein the boost line comprises a boost valve.

7. The method of claim 6, wherein a choke line is positioned in the wellbore operation below the seal of the blow out preventer, and the choke line comprises a choke valve, and wherein the boost valve and the choke valve are operable to control pressure in the wellbore operation.

8. The method of claim 1, wherein a piston system drives the ram between the retracted position and the extended position.

9. The method of claim 1, wherein the hold shoulder extends from a larger diameter to a smaller diameter.

10. The method of claim 1, wherein the upper shoulder extends from a smaller diameter to a larger diameter.

11. The method of claim 1, wherein the lower shoulder extends from a larger diameter to a smaller diameter.

12. The method of claim 1, wherein the hold shoulder forms a hold angle with a longitudinal axis of the riser adapter, and the lower shoulder forms a lower angle with the longitudinal axis, wherein the hold angle is equal to the lower angle.

* * * * *